US012180953B2

(12) United States Patent
Alers et al.

(10) Patent No.: US 12,180,953 B2
(45) Date of Patent: Dec. 31, 2024

(54) REDUNDANT PUMPING SYSTEM AND PUMPING METHOD BY MEANS OF THIS PUMPING SYSTEM

(71) Applicant: Ateliers Busch SA, Chevenez (CH)

(72) Inventors: Paul Alers, Porrentruy (CH); Jeihong Kim, Icheon-si (KR); Jean-Eric Larcher, Sevenans (FR)

(73) Assignee: Ateliers Busch SA, Chevenez (CH)

( * ) Notice: Subject to any disclaimer, the term of this patent is extended or adjusted under 35 U.S.C. 154(b) by 0 days.

(21) Appl. No.: 17/781,515

(22) PCT Filed: Dec. 4, 2019

(86) PCT No.: PCT/EP2019/083664
§ 371 (c)(1),
(2) Date: Jun. 1, 2022

(87) PCT Pub. No.: WO2021/110257
PCT Pub. Date: Jun. 10, 2021

(65) Prior Publication Data

US 2023/0003208 A1 Jan. 5, 2023

(51) Int. Cl.
*F04B 41/06* (2006.01)
*F04C 18/12* (2006.01)
(Continued)

(52) U.S. Cl.
CPC ..... *F04B 41/06* (2013.01); *F04C 18/126* (2013.01); *F04C 18/16* (2013.01); *F04C 23/005* (2013.01);
(Continued)

(58) Field of Classification Search
CPC .. F04B 41/06; F04B 2205/09; F04C 18/0215; F04C 18/18; F04C 18/126; F04C 18/16;
(Continued)

(56) References Cited

U.S. PATENT DOCUMENTS 4,850,806 A * 7/1989 Morgan ..... F04B 37/14 417/205
6,200,107 B1 * 3/2001 Brewster ..... F04D 27/0207 417/520
(Continued)

FOREIGN PATENT DOCUMENTS

DE 20 2015 004 596 U1 9/2015
WO 2018100342 A1 6/2018

OTHER PUBLICATIONS

International Search Report and Written Opinion issued in PCT/EP2019/083664 dated Feb. 10, 2020, 7 pages.

*Primary Examiner* — Kenneth J Hansen
*Assistant Examiner* — Joseph S. Herrmann
(74) *Attorney, Agent, or Firm* — Tucker Ellis LLP

(57) ABSTRACT

The present invention relates to a redundant vacuum pumping system (300) and a pumping method using this system, comprising a primary roots pump (302), a first pumping sub-system (310) and a second pumping sub-system (320), wherein the first pumping sub-system (310) and the second pumping sub-system (320) are arranged to pump in parallel the gas evacuated by the primary roots pump (302), the first pumping sub-system (310) comprising a first secondary roots pump (311) and a first positive displacement pump (312) and a first valve (313) positioned between the gas discharge outlet (302*b*) of the primary roots pump (302) and the gas suction inlet (311*a*) of the first secondary roots pump (311), and the second pumping sub-system (320) comprising a second secondary roots pump (311) and a second positive displacement pump (312) and a second valve (323) positioned between the gas discharge outlet (302*b*) of the primary roots pump (302) and the gas suction inlet (321*a*) of the second secondary roots pump (321). According to the invention, the first pumping sub-system (310) and the second pumping sub-system (320) are configured to pump at a
(Continued)

same flow rate, and the primary roots pump (302) is configured to be able to pump at a flow rate F equal to the pumping flow rate of the primary pumping sub-system (310) plus the pumping flow rate of the secondary pumping sub-system (320).

15 Claims, 3 Drawing Sheets

(51) Int. Cl.

| | |
|---|---|
| ***F04C 18/16*** | (2006.01) |
| ***F04C 23/00*** | (2006.01) |
| ***F04C 25/02*** | (2006.01) |
| ***F04C 28/02*** | (2006.01) |
| ***F04C 28/24*** | (2006.01) |
| ***F04C 28/26*** | (2006.01) |
| *F04C 18/02* | (2006.01) |
| *F04C 18/18* | (2006.01) |
| *F04C 28/28* | (2006.01) |

(52) U.S. Cl.
CPC ..... *F04C 23/006* (2013.01); *F04C 25/02* (2013.01); *F04C 28/02* (2013.01); *F04C 28/24* (2013.01); *F04C 28/26* (2013.01); *F04B 2205/09* (2013.01); *F04C 18/0215* (2013.01); *F04C 18/18* (2013.01); *F04C 28/28* (2013.01); *F04C 2220/10* (2013.01)

(58) Field of Classification Search
CPC ..... F04C 23/005; F04C 23/006; F04C 25/02; F04C 28/02; F04C 28/24; F04C 28/26; F04C 28/28; F04C 2220/10; F04C 2220/12; C23C 16/4412; H01L 21/67; H01L 21/68
USPC ..... 118/715–733; 156/345.25; 417/248
See application file for complete search history.

(56) References Cited

U.S. PATENT DOCUMENTS

| | | | | |
|---|---|---|---|---|
| 6,254,685 | B1 * | 7/2001 | Kraft | C23C 16/4412 118/715 |
| 9,175,688 | B2 * | 11/2015 | Neel | F04D 27/004 |
| 2002/0131870 | A1 * | 9/2002 | Puech | F04B 45/04 417/205 |
| 2005/0082001 | A1 * | 4/2005 | Sugiura | H01J 37/32862 134/1.1 |
| 2012/0222813 | A1 * | 9/2012 | Pal | C23C 16/4412 156/345.31 |
| 2013/0340842 | A1 * | 12/2013 | Daykin | F04D 17/168 137/15.01 |
| 2017/0200622 | A1 * | 7/2017 | Shiokawa | C23C 14/22 |
| 2018/0112666 | A1 | 4/2018 | Dreifert et al. | |
| 2023/0003208 | A1 * | 1/2023 | Alers | F04C 28/26 |

* cited by examiner

-- PRIOR ART --

-- PRIOR ART --

REDUNDANT PUMPING SYSTEM AND PUMPING METHOD BY MEANS OF THIS PUMPING SYSTEM

TECHNICAL FIELD

The present invention relates to the field of vacuum technology. More precisely, the present invention concerns a redundant pumping system comprising at least one primary roots pump and two pumping sub-systems arranged in parallel. The present invention relates as well to a pumping method by means of this pumping system.

BACKGROUND OF THE INVENTION

Vacuum pumping systems are indispensable devices in many industrial fields such as for instance in the food and pharmaceutical industries in freeze drying, distillation, packaging and crystallization processes. and in particular also in the semiconductor industry.

In order to reach manufacturing processes of always better quality in the semiconductor industry, it is essential that the manufacturing processes be performed under well-controlled atmospheres. With vacuum pumps, it is possible to evacuate process chambers and to provide the clean, low-pressure environment required for many processes as well as to remove unused process gas and by-products. The manufacturing process of semiconductor devices often involves the sequential deposition and patterning of multiple layers. Many of these process steps require vacuum conditions in the process chamber to prevent interference and contamination by gas molecules present in air. Several process steps in the manufacturing of semiconductor devices are usually carried out in process chamber, for instance a vacuum oven, in which wafers are processed for example by chemical vapor deposition or chemical vapor etching. All these processes require a low background pressure in order to avoid contamination mainly by water vapor as well the ability to supply inside the process chamber a process gas. This process gas must be supplied into the process chamber with a precise flow rate, which is normally high. Therefore, pumping systems for the evacuation and maintaining of a predetermined pressure of process gases in semiconductor process chambers need to be able to evacuate the process chamber to a low end-pressure, usually at least $10^{-2}$ mbar, and to handle a high flow rate, in the range of several ten thousands of liter per minute. For this purpose, a roots pump, also called vacuum booster, and a dry backing pump are typically combined. The roots pump allows for the handling of the high flow rate and the backing pump, thanks to its high compression ratio, allows for reaching a sufficiently low end-pressure.

Nowadays, in the semiconductor industry, hundreds or even thousands of wafers are processed at the same time in a single process chamber. A failure of the pumping system during the manufacturing process can therefore result in wafers damages and consequently in a very significant financial loss. In order to prevent a failure of the pumping system from having such consequences, it is known and usual to provide for a redundant pumping system. The purpose of a redundant system is to ensure that, when the pump maintaining the process conditions in the process chamber fails, a second pump can take over to prevent too important changes in the process conditions and eventually wafers damages.

Several redundant pumping systems, in particular in the field of semiconductor industry, are known from the prior art. In a first known redundant pumping system, schematically illustrated in FIG. 1, two pumping sub-systems are arranged in parallel. Each of the two sub-systems comprise a roots pump and a positive displacement pump, as backing pump for the booster pump. For each pumping sub-system, a valve is positioned on the duct connecting the roots pumps and the process chamber. The pumping sub-systems are configured such that each of the sub-system can evacuate alone the process chamber at the desired flow rate. This implies that during normal operation, the two sub-systems are always running but only one valve is open. If the pumping sub-system whose valve is open fails, this valve is closed and the valve of the other pumping sub-system is opened in order to allow the second sub-system to take over.

This kind of redundant systems however has several drawbacks. When a failure happens, severe pressure hunting and contamination of the process chamber are observed. This usually results in heavy damages of the wafers present in the process chamber and in important financial losses.

A second known redundant pumping system used in the semiconductor industry, illustrated in FIG. 2, comprises a roots pump connected to the process chamber and two positive displacement pumps arranged in parallel. These two positive displacement pumps are separated from the roots pump by two valves. During normal operation, only one of the both valves is open and only one of the positive displacement pumps acts as backing pump for the roots pump. If this backing pumps fails, the corresponding valve closes and the other valve opens, allowing the second positive displacement pump to act as backing pump for the roots pump.

This second known redundant pumping system has slightly better performances then the above-mentioned first known redundant pumping system in terms of contaminations when a positive displacement pump fails. However, very severe damages of the wafers in the process chamber happen if the roots pump of the system fails.

It is therefore a goal of the present invention to propose a novel redundant pumping system and a corresponding pumping method, thanks to which the pressure conditions in a process chamber can be maintained constant even if one of the pumps of the system fails. Thus, the object of the present invention is to propose a novel redundant pumping system and a corresponding pumping method, thanks to which the above-described drawbacks of the known systems are completely overcome or at least greatly diminished.

SUMMARY OF THE INVENTION

According to the present invention, these objects are achieved in particular through the elements of the two independent claims. Further advantageous embodiments follow moreover from the dependent claims and the description.

In particular, the objects of the present invention are achieved in a first aspect by a redundant vacuum pumping system, comprising a primary roots pump having a gas suction inlet connectable to a process chamber and a gas discharge outlet connected to a first pumping sub-system and a second pumping sub-system, wherein the first pumping sub-system and the second pumping sub-system are arranged to pump in parallel the gas evacuated by the primary roots pump, the first pumping sub-system comprising a first secondary roots pump, a first positive displacement pump and a first valve positioned between the gas discharge outlet of the primary roots pump and the gas suction inlet of the first secondary roots pump, and the second pumping sub-system comprising a second secondary roots pump, a second positive displacement pump and a second valve positioned between the gas discharge outlet of the primary roots pump and the gas suction inlet of the second secondary roots pump, wherein the first pumping sub-system and the second pumping sub-system are configured to pump at a same flow rate, and wherein the primary roots pump is configured to be able to pump at a flow rate F equal to the pumping flow rate of the primary pumping sub-system plus the pumping flow rate of the secondary pumping sub-system.

Thanks to such a redundant vacuum pumping system, it is possible to ensure that the pressure level in a process chamber can be maintained constant even in the case of failure of one the pumps of the system. It is in particular possible to avoid pressure hunting or contamination of the process chamber in case of failure. Since the primary roots pump is configured to be drivable at the pumping flow rate equal to the total flow rate of the two pumping sub-systems, the primary roots pump can, in case of failure of one of the sub-system, compress the gases evacuated from the process chamber enough that the pumping conditions for the sub-system still running are not changed. In case of failure of the primary roots pump, the gas flow can be pumped by the sub-systems alone. Thanks to the redundant pumping system according to the present invention it is therefore possible to overcome the drawbacks of the systems known from the prior art.

In preferred embodiments of the present invention, the first positive displacement pump and/or the second positive displacement pump are selected among the group consisting of a dry screw pump, a dry claw pump, a scroll pump, and a diaphragm pump.

In a further preferred embodiment of the present invention, the redundant vacuum pumping system comprises comprising a bypass duct with a third valve arranged in parallel to the primary roots pump. Thanks to the bypass duct and the third valve, it is possible to evacuate the flow of gas to be evacuated from the process chamber even if the primary roots pump becomes a pumping obstacle due to failure.

In another preferred embodiment of the present invention, the first positive displacement pump and the second positive displacement pump are connected to waste gas treatment installations, advantageously scrubbers. With this, is possible to recycle process gases and process by-products evacuated from the process chamber.

In yet another preferred embodiment of the present invention, the pumping flow rate of the primary roots pumps is from 5'000 l/min to 100'000 l/min, advantageously between 10'000 l/min and 70'000 l/min, preferably between 25'000 l/min and 55'000 l/min. With this, the redundant vacuum pumping system of the present invention can be implemented in existing manufacturing lines, especially in the semiconductor industry.

In a further preferred embodiment of the present invention, the redundant vacuum pumping system comprises failure detecting means for detecting a failure of any of the primary roots pump, of the first secondary roots pump, of the second secondary roots pump, of the first positive displacement pump or of the second positive displacement pump. Thanks to these failure detection means, it is possible to detect rapidly any failure and to switch in consequence a valve, if required.

In a further preferred embodiment of the present invention, the failure detecting means are configured to be able to actuate the first valve, the second valve, and/or the third valve in case of a detected failure. This is particularly advantageous since in case of a detected failure the correct valve can be actuated automatically by the failure detecting means.

In a second aspect, the objects of the present invention are achieved by a pumping method by means of a redundant vacuum pumping system according to the present invention, wherein the primary roots pump is driven all the time at a nominal flow rate equal to the sum of the flow rate of the first pumping sub-system and of the flow rate of the second pumping sub-system. With this pumping method, it is ensured that even in case of failure of any of the pumps of the redundant vacuum pumping system, the pressure level in the process chamber can be maintained constant and wafer damages avoided.

In a first preferred embodiment of the second aspect of the present invention, the pumping system comprises a bypass duct with a third valve and wherein the third valve is switched to its open position when a failure of the primary roots pump is detected by the failure detecting means. Thanks to this, the flow of gas that needs to be evacuated from the process chamber can be evacuated through the bypass duct in case of failure of the primary roots pump of the redundant vacuum pumping system.

In another preferred embodiment of the second aspect of the present invention, the failure detecting means close the first valve when a failure of the first secondary roots pump or of the first positive displacement pump is detected. With this, it is possible to close automatically the first vale in case of failure of any of the pumps of the first pumping sub-system.

In yet another preferred embodiment of the second aspect of the present invention, the failure detecting means close the second valve when a failure of the second secondary roots pump or of the second positive displacement pump is detected. With this, it is possible to close automatically the second vale in case of failure of any of the pumps of the second pumping sub-system.

BRIEF DESCRIPTION OF THE DRAWINGS

The specific embodiments and advantages of the present invention will become apparent from the attached Figures that show.

DETAILED DESCRIPTION OF A PREFERRED EMBODIMENT

Figure 1:
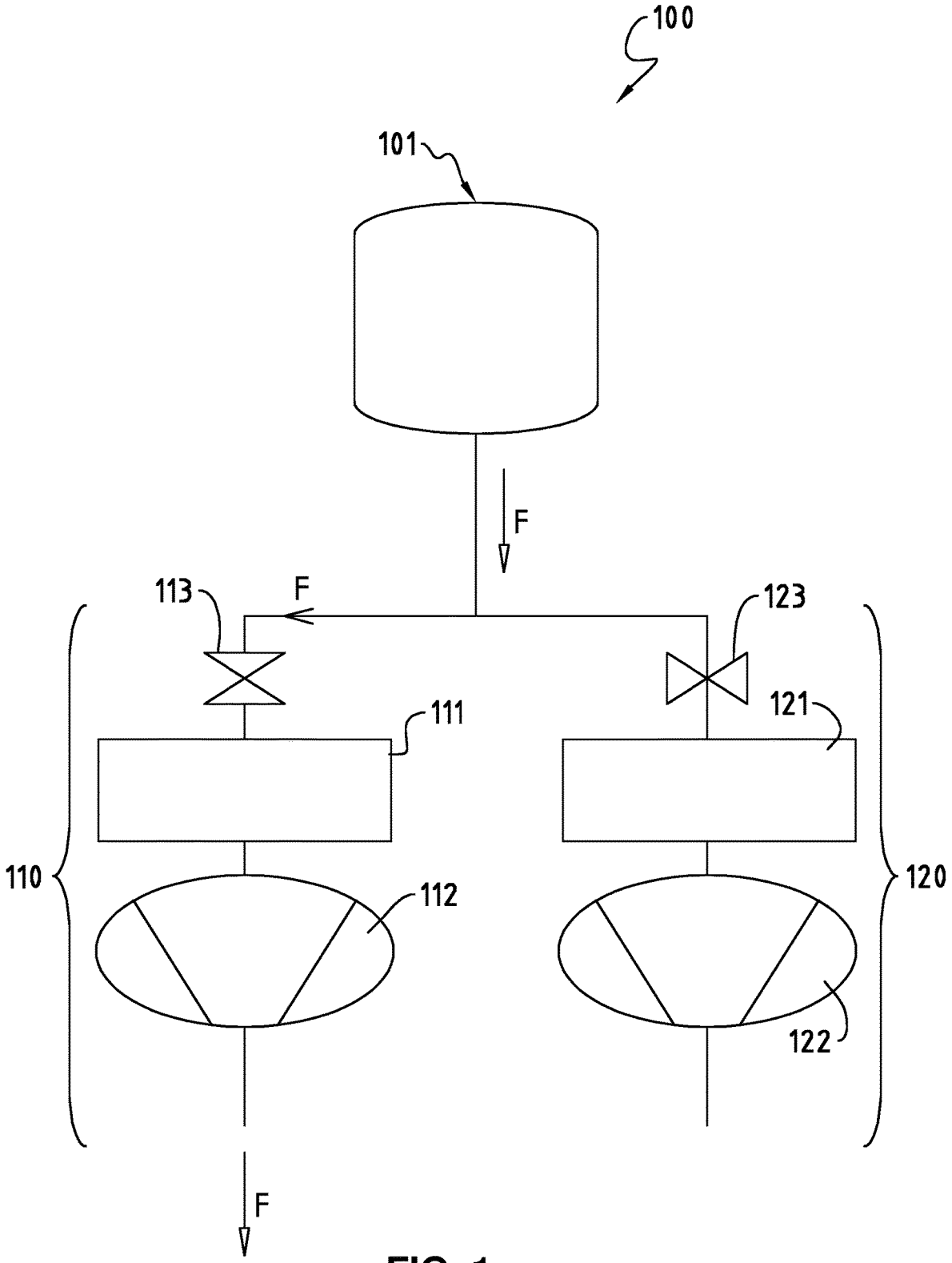
FIG. 1 is a schematic illustration of a first redundant pumping system known from the prior art.

FIG. 1 schematically illustrates a first redundant pumping system 100 known from the prior art. The known redundant pumping system 100 comprises two pumping sub-systems 110 and 120 arranged in parallel for pumping the process chamber 101. As mentioned above, redundant pumping systems are provided in situation in which it must absolutely be ensured that the pressure level in the chamber 101 is maintained at all time during certain manufacturing processes, especially in the semiconductor industry.

The pumping system 100 must be configured not only to be able to reach a predetermined end-pressure but to handle a large flow of gases F. This is in particular important where chemical vapor etching processes or chemical vapor deposition are involved. These processes require that a constant flow of process gases is fed into the chamber 101, these gases and the residues of the processes having to be pumped away by the pumping system 100. In order to reach a sufficiently low end-pressure and to be able to pump a large flow of gases, the known pumping systems typically used in the semiconductor industry employ a combination of a positive displacement pump, advantageously a dry screw pump, and a roots pump, known also as booster pump. Thanks to the dry screw pump with its high compression ratio, a low end-pressure can be reached, while with the roots pump a very large flow of gases can efficiently be handled.

Referring back to FIG. 1, each of the two pumping sub-systems 110, 120 comprise therefore a roots pump 111, 121 and a dry screw pump 112, 122. As mentioned above, the two sub-systems are arranged in parallel and are connected to the process chamber 101 by means of two valves 113, 123. The pumping system 100 is redundant in the sense that, during normal operation, the valve 113 is open and the valve 123 is closed. The flow of gases F pumped out of the process chamber 101 is therefore, during normal operation, pumped by the sub-system 110 alone. Only in case of failure of either pump of this sub-system, the valve 113 is closed and the valve 123 opened such that the chamber 101 is evacuated by the sub-system 120 alone.

Redundant pumping system, like system 100 of FIG. 1, has however many drawbacks. First, it suffers from severe pressure hunting when the system must switch from sub-system 110 to sub-system 120. This pressure hunting leads to contamination in the process chamber 101 which are unacceptable in many applications. Furthermore, during a certain amount of time after the detection of the failure of sub-system 110, the pressure will raise in the process chamber 101 eventually leading to wafer damaging kept in the chamber 101. Finally, since during normal operation pumps 121 and 122 of sub-system 120 are running all the time, the pressure between the inlet of roots pump 121 and valve 123 is kept at the end-pressure of sub-system 120. This implies that, when valve 123 is suddenly opened in reaction to a failure detection of sub-system 110, the pressure in the process chamber will be affected. Such pressure changes make impossible to guarantee high-quality process conditions in the process chamber.

Figure 2:
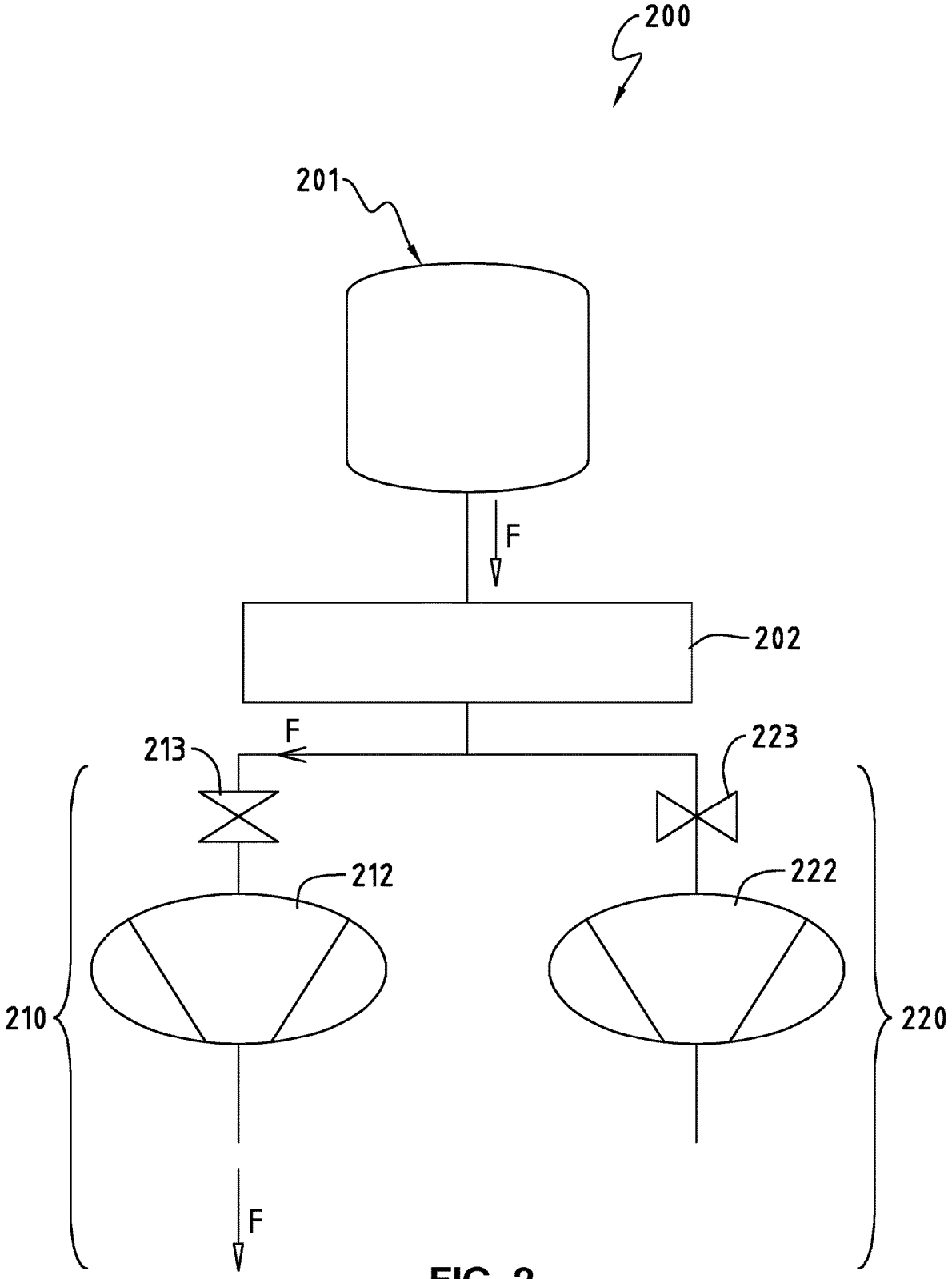
FIG. 2 is a schematic illustration of a second redundant pumping system known from the prior art.

FIG. 2 schematically illustrates a second redundant pumping system 200 known from the prior art. The system 200 differs from system 100 in that the two pumping sub-systems 210, 220 comprise each only a positive displacement pump 212, 222, such as a dry screw pump. In order to handle an important flow of gas F, the system 200 comprises a roots pump 202, which is "mutual" to both sub-systems 210 and 220. During normal operation, valve 213 is open and valve 223 is closed. The entire flow of gas F is therefore pumped solely by the roots pump 202 and the dry screw pump 212. In case of failure of the dry screw pump 212, the valve 213 is closed and the valve 223 is opened such that the flow of gas F can be evacuated by the combination of the roots pump 202 and the dry screw pump 222.

While the redundant system 200, in comparison to the redundant system 100, has improved performances in terms of being able to maintain a constant pressure in the process chamber 201 in case of failure of the dry screw pump 212, it has the major drawback that a failure of the roots pump 202 results in an unacceptable and constant raise of pressure in the process chamber 201.

Figure 3:
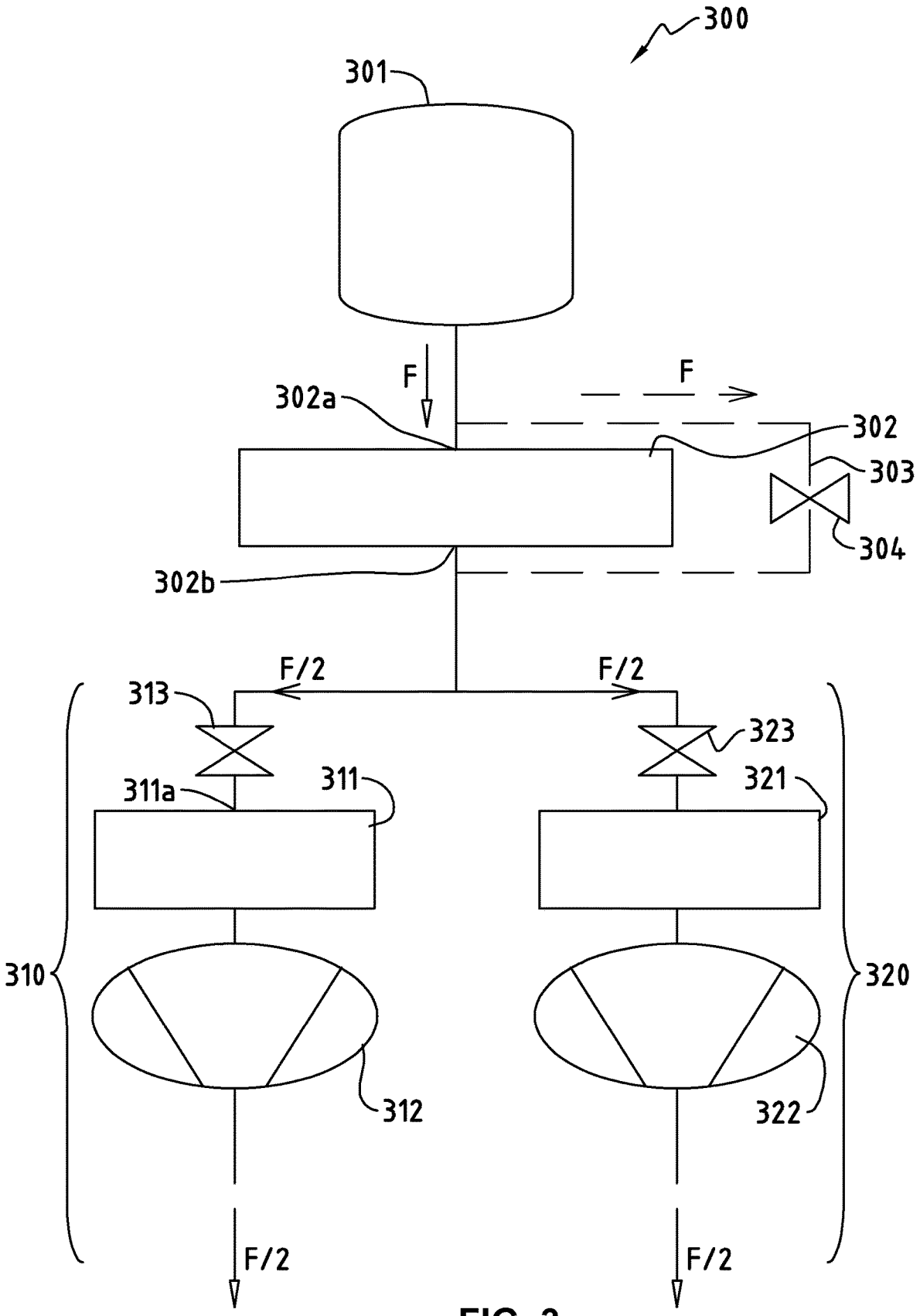
FIG. 3 is a schematic illustration of a preferred embodiment of a redundant pumping system according to the present invention.

FIG. 3 schematically illustrates a redundant pumping system 300 according to a preferred embodiment of the present invention. The pumping system 300 comprises a primary roots pump 302, connectable to a process chamber 301, and two pumping sub-systems 310 and 320, each of them comprising a secondary roots pump 311, respectively 321, and a positive displacement pump 312, respectively 322, such as dry screw pumps. During normal operation, the valve 313 and the valve 323 are always open, half of the gas flow F evacuated from the process chamber 301 being pumped by the sub-system 310, and the other half being pumped by the sub-system 320. Essential for the proper implementation of this invention is that the primary roots pump 302 is drivable at the same pumping speed as the total pumping speed of the sub-systems 310 and 320. In other terms, during normal operation, the primary roots pump 302 is not participating in the pumping effort and the pressure P1 at its inlet 302*a* is the same as the pressure P2 at its outlet 302*b*, i.e. the compression ratio of the primary roots pump 302 in normal operation is equal to 1. This can be achieved by having a primary roots pump whose pumping speed can be adapted or by having a primary roots pump whose maximal pumping speed is equal to the pumping speed of the sub-systems 310 and 320.

The idea beyond the present invention is better explained with a concrete implementation example. For this example, let us assume that the flow rate of gas F required to be evacuated from the process chamber is equal to 20'000 l/min. As mentioned above, the inventive redundant pumping system 300 is configured such that the primary roots pump 302 can be driven with a pumping speed equal to F and such that each sub-system 310 and 320 has a pumping speed equal to F/2, in this example equal to 10'000 l/min. Since the entering and existing flow rates of the primary roots pump 302 are equal, the compression ratio of the primary roots pump 302 during normal operation $K_{normal}$ is equal to 1.

This means that during normal operation, the performances of the pumping system 300 in terms of pumping speed and end-pressure are the same as if the primary roots pump 302 would not be present, would be switched off or would fail (as long as it does not represent an obstacle to the evacuation). During normal operation, the end pressure of the complete system 300 is given by the end pressure of each of the sub-systems 310, respectively 320, divided by $K_0$, the compression ratio at zero flow rate and at its outlet pressure. Typically, sub-systems 310, respectively, 320, have an end-pressure of the order of 0.1 mbar. Primary roots pumps have in this pressure range a compression ratio $K_0$ of the order of 50. The end pressure of the whole system 300 is consequently of the order of $2*10^{-4}$ mbar.

If now the sub-system 320 would fail, the valve 323 will be closed and the whole flow F would need to be accommodated by the combination of the primary roots pump 302 and the sub-system 310. Since the flow rate of the sub-system 310 is fixed and equal to F/2, the primary roots pump 302 must compress the gas evacuated from the process chamber with a factor 2. This happens automatically as soon as the flow rate beyond the primary roots pumps 302 drops from F down to F/2 due to the failure of the sub-system 320. Naturally, the pressure P3 at the inlet of the sub-system 311*a* becomes two times higher than during normal operation, but since the primary roots pump 302 now participates in the pumping effort by compressing the gas evacuated from the processing chamber 301 by a factor 2, the end-pressure as well as the pumping speed are not affected by the failure of sub-system 320 and the pressure in the process chamber can be maintained constant even in that case.

Furthermore, as mentioned above, in case of failure of the primary roots pump 302, the performances of the system 300 are not affected at all as long as the two sub-systems 310 and 320 are running normally. As it is extremely improbable that the primary roots pump 302 and one of the sub-systems 310 or 320 would fail at the same time, the redundant pumping system 300 according to the present invention allows for circumventing the drawbacks of the redundant systems known from the prior art.

Moreover, it is possible to provide in addition for a bypass duct 303 with a valve 304 in the pumping system 300. With the additional bypass duct 303 it is possible to evacuate the process chamber 301 with the two sub-systems 310 and 320 and to maintain a constant pressure in the chamber 301 even if the primary roots pump 302 becomes a pumping resistance du to failure. In such a case, the flow F is deviated through the bypass duct 304 and directed in the two sub-systems 310 and 320.

Furthermore, it is advantageous to connect the gas discharge outlet of both positive displacement pumps 312 and 322 to at least one waste gas treatment installation, advantageously scrubbers.

Finally, it should be pointed out that the foregoing has outlined one pertinent non-limiting embodiment. It will be clear to those skilled in the art that modifications to the disclosed non-limiting embodiment can be effected without departing from the spirit and scope thereof. As such, the described non-limiting embodiment ought to be considered merely illustrative of some of the more prominent features and applications. Other beneficial results can be realized by applying the non-limiting embodiments in a different manner or modifying them in ways known to those familiar with the art.

The invention claimed is:

1. A redundant vacuum pumping system, comprising:

a primary roots pump having a gas suction inlet connected to a process chamber and a gas discharge outlet connected to a first pumping sub-system and a second pumping sub-system, wherein the process chamber is configured to treat a device via chemical vapor deposition or chemical vapor etching while the device is resident in said process chamber, wherein the first pumping sub-system and the second pumping sub-system are arranged to pump in parallel gas evacuated by the primary roots pump, the first pumping sub-system comprising a first secondary roots pump, a first positive displacement pump and a first valve positioned between the gas discharge outlet of the primary roots pump and a gas suction inlet of the first secondary roots pump, and the second pumping sub-system comprising a second secondary roots pump, a second positive displacement pump and a second valve positioned between the gas discharge outlet of the primary roots pump and a gas suction inlet of the second secondary roots pump, wherein:

the primary roots pump receives the gas directly from the process chamber, the primary roots pump is configured to be able to pump at a flow rate F equal to a pumping flow rate of the first pumping sub-system plus a pumping flow rate of the second pumping sub-system, a pressure at the gas suction inlet of the primary roots pump is equal to a pressure at the gas discharge outlet of the primary roots pump, a pressure at a gas discharge outlet of the first secondary roots pump is higher than a pressure at the gas suction inlet of the first secondary roots pump, and a pressure at a gas discharge outlet of the second secondary roots pump is higher than a pressure at the gas suction inlet of the second secondary roots pump.

2. The redundant vacuum pumping system according to claim 1, wherein the first positive displacement pump and/or the second positive displacement pump is a dry screw pump.

3. The redundant vacuum pumping system according to claim 1, wherein the first positive displacement pump and/or the second positive displacement pump is a dry claw pump.

4. The redundant vacuum pumping system according to claim 1, wherein the first positive displacement pump and/or the second positive displacement pump is a scroll pump.

5. The redundant vacuum pumping system according to claim 1, wherein the first positive displacement pump and/or the second positive displacement pump is a diaphragm pump.

6. The redundant vacuum pumping system according to claim 1, comprising a bypass duct with a third valve arranged in parallel to the primary roots pump.

7. The redundant vacuum pumping system according to claim 1, wherein each of the first and second secondary roots pumps receives the gas directly from the primary roots pump when the first and second valves are opened.

8. The redundant vacuum pumping system according to claim 1, wherein the first positive displacement pump and the second positive displacement pump are connected to waste gas treatment installations.

9. The redundant vacuum pumping system according to claim 8, wherein the waste gas treatment installations comprises scrubbers.

10. The redundant vacuum pumping system according to claim 1, wherein a pumping flow rate of the primary roots pump is from 5,000 liters/min to 100,000 liters/min.

11. The redundant vacuum pumping system according to claim 10, wherein the pumping flow rate of the primary roots pump is between 10,000 liters/min and 70,000 liters/min.

12. The redundant vacuum pumping system according to claim 11, wherein the pumping flow rate of the primary roots pump is between 25,000 liters/min and 55,000 liters/min.

13. A pumping method by means of the redundant vacuum pumping system according to claim 1, wherein the redundant vacuum pumping system comprises a bypass duct with a third valve and wherein the third valve is switched to its open position when a failure of the primary roots pump is detected.

14. A pumping method by means of the redundant vacuum pumping system according to claim 1, wherein the first valve closes when a failure of the first secondary roots pump or of the first positive displacement pump is detected.

15. A pumping method by means of the redundant vacuum pumping system according to claim 1, wherein the second valve closes when a failure of the second secondary roots pump or of the second positive displacement pump is detected.

* * * * *